US005249953A

United States Patent [19]

Roth

[11] Patent Number: 5,249,953

[45] Date of Patent: Oct. 5, 1993

[54] GAS DISTRIBUTING AND INFRARED RADIATING BLOCK ASSEMBLY

[75] Inventor: Reinhold C. Roth, Newport, R.I.

[73] Assignees: Hercules Canada, Inc.; 285550 British Columbia Ltd.; 285562 British Columbia Ltd., Canada

[21] Appl. No.: 971,673

[22] Filed: Nov. 4, 1992

Related U.S. Application Data

[63] Continuation of Ser. No. 625,752, Dec. 10, 1990, abandoned, which is a continuation of Ser. No. 538,376, Jun. 14, 1990, filed as PCT/US88/02085, Jun. 17, 1988, abandoned.

[30] Foreign Application Priority Data

Jun. 16, 1989 [CA] Canada ..... 603136

[51] Int. Cl.[5] ..... F23D 14/16

[52] U.S. Cl. ..... 431/7; 431/328; 126/92 AC

[58] Field of Search ..... 431/7, 170, 326, 328, 431/329, 346; 126/92 R, 92 AC, 92 B, 92 C

[56] References Cited

U.S. PATENT DOCUMENTS

| | | | |
|---|---|---|---|
| 1,249,366 | 12/1917 | Fisher | 431/328 |
| 1,830,826 | 11/1931 | Cox . | |
| 2,102,152 | 12/1937 | Hays | 431/170 |
| 2,194,207 | 3/1940 | Moran | 158/99 |
| 2,194,208 | 3/1940 | Moran | 431/328 |
| 3,087,091 | 4/1963 | Vonk | 431/328 X |
| 3,216,478 | 11/1965 | Saunders et al. | 158/116 |
| 3,324,924 | 6/1967 | Hailstone et al. | 431/328 |
| 3,472,601 | 10/1969 | Yamamura et al. | 431/328 |
| 3,635,644 | 1/1972 | Reid, Jr. | 431/9 |
| 3,738,793 | 6/1973 | Reid et al. | 431/328 |
| 3,885,907 | 5/1975 | Teague, Jr. | 431/328 |
| 3,912,443 | 10/1975 | Ravault et al. | 431/328 |
| 3,947,233 | 3/1976 | Sundberg | 431/328 |
| 4,643,667 | 2/1987 | Fleming | 431/7 |
| 4,889,481 | 12/1989 | Morris et al. | 431/328 |

FOREIGN PATENT DOCUMENTS

| | | |
|---|---|---|
| 248062 | 7/1966 | Australia . |
| 1303596 | 5/1972 | Fed. Rep. of Germany . |
| 479347 | 3/1972 | Japan . |

*Primary Examiner*—Carl D. Price
*Attorney, Agent, or Firm*—Christie, Parker & Hale

[57] ABSTRACT

A radiant burner assembly for a gas fired infrared burner has a first block of permeable material for transporting and distributing a mixture of combustion gas and air. A second block of material which has properties different from the material of the first block completes transport and distribution of the mixture and provides a combustion zone in which the mixture burns and heats the outer surface of the second block to incandescence for efficient infrared radiation. The pore spaces through which gas flows in the second block are larger than the pores spaces through which gas flows in the first block so that the mixture expands to form a turbulent mixture in the second block. Varying pore size may be provided in each block of material. Ceramic materials are used for withstanding elevated temperatures.

32 Claims, 2 Drawing Sheets

GAS DISTRIBUTING AND INFRARED RADIATING BLOCK ASSEMBLY

CROSS-REFERENCE TO RELATED APPLICATION

This is a continuation of application Ser. No. 07/625,752, filed Dec. 10, 1990, abandoned, which is a continuation of U.S. patent application Ser. No. 07/538/376, filed Jun. 14, 1990, filed as PCT/US88/02085, Jun. 17, 1988, now abandoned.

This invention relates to gas-fired infrared burners and in particular to how the gas is distributed to the combustion zone and allowed to burn so as to efficiently emit radiation energy.

BACKGROUND OF THE INVENTION

In prior art burners, the gas is distributed to the combustion zone through specially designed orifices or parts which are formed within a unitary block or plate of ceramic material. However, it is important to note not only that this does single block/plate of material serves to transport and distribute the gas to the burning zone, but also that the top layer of that same material serves as the combustion zone, which on being heated to incandescence also serves to produce the infrared radiation or radiant heat flux. Thus, it is clear that the unitary material of prior art burner blocks serves at least four functions: namely transportation, distribution, combustion and radiation.

In other prior art burners involving multi-layed porous ceramic material, the coarse, granular nature of the material that may be used does not give the required precision in pore size/uniformity, or the wrong materials are specified for maximum heat transfer and reticular integrity at very high temperatures (and low temperature water shock), or the combustion takes place in a layer where maximum use cannot be made of the three modes of heat transfer, namely conduction, convection and radiation during the combustion and thus be unable to enhance the final radiation.

SUMMARY OF THE INVENTION

Since these functions require different material requirements in order to operate efficiently, it is an object of this invention to provide different materials and/or materials having different properties for these functions and thus, to provide a composite rather than a unitary material for these functions. In a special case, which involves the function of reverberation/enhancement, which in prior art burners is effected by a separate layer of material lying above the main unitary block of material, it is also an object of this invention to combine this separate special layer into the composite block assembly of this invention. In a preferred embodiment of the present invention, all three modes of heat transfer, i.e. conduction, convection and radiation, are able to function to their maximum in this special layer, which takes the form of a reverberation porous cellular/reticular ceramic layer. It is understood that this special layer is not granular in nature, but is a network of connected open spaces which are separated by a wall/film-like structure of relatively large pore size and high apparent porosity. (Such a non-granular structure is preferably used in the other layers). Where possible, depending on the application, essentially all of the combustion will take place in this special reverberatory layer, so that the composite assembly will in such a case consist of only two layers/blocks, each having specifications within a specific range, i.e. thickness, pore size and apparent porosity and/or channel size.

By providing the proper material for these functions, it is a further object of this invention to maximize the performance of these functions so as to increase the radiation efficiency of infrared burners and to make them safer to use.

Thus, in its broadest aspect, the invention is directed towards a method for providing a burner assembly for gas-fired infrared burners, which comprises:

(a) providing means comprising a first block of material for transporting and distributing a mixture of combustion gas and air;

(b) providing means comprising a second block of material, which has properties different from the material in said first block, for completing said transportation and distribution of said mixture and providing a combustion zone, wherein said mixture can burn and heat the top surface of said second block of material to incandescence, such that it will produce very efficient infrared radiation; and (c) combining said first and second blocks of material to form a burner assembly.

Similarly, the invention is directed to an apparatus which provides a burner assembly for gas-fired infrared burners, which comprises:

(a) means comprising a first block of material for transporting and distributing a mixture of combustion gas and air;

(b) means comprising second block of material, which has properties different from the material in said first block, for completing said transportation and distribution of the said mixture and providing a combustion zone, wherein said gas can burn and heat the top surface of said second block of material to incandescence such that it will produce very efficient infrared radiation; and (c) means for combining said first and second blocks of material to form a burner assembly.

In the further embodiment, the invention involves a method for producing infrared radiation, which comprises the steps of:

(a) forcing a pressurized mixture of combustion gas and air through a multitude of small first spaces connected together in a first block of material, at a velocity which is greater than the velocity of the flame propagation in the mixture, into a second block of material, which, while containing a multitude of spaces connected together which are larger than those of the first spaces, is combined with said first block to form a composite burner block assembly;

(b) allowing said mixture to expand and form a turbulent mixture in said second block; and (c) allowing said turbulent mixture to ignite and burn, thereby heating the top surface of said second block to a very high incandescence temperature and causing it to produce very efficient infrared radiation.

In a further embodiment, the invention involves a method for producing infrared radiation, which comprises the steps of:

(a) forcing a pressurized mixture of combustion gas and air through a multitude of small distinct channels in a first block of material, each channel being perpendicular to a radiation surface and consisting of first and second sections, the first section having a cross-sectional area smaller than that of the second section such that the velocity of the mixture through said first section is greater then the velocity of the flame propagation in the mixture, the cross-sectional area of the second section being a varying one commencing with that of the first section and then expanding in bowl-shaped fashion until the second section makes contact with a second block of material, consisting of a multitude of spaces connected together, into which the mixture is forced to flow, and which combined with said first block forms a burner block assembly;

(b) allowing said mixture to expand and form a turbulent mixture in said section of said first block and in said spaces of said second block; and (c) allowing said turbulent mixture to ignite and burn in said second block of material, thereby heating the top surface of said second block to a very high incandescence temperature and causing it to produce very efficient infrared radiation.

In a still further embodiment, the invention involves a method for producing infrared radiation, which comprises the steps of:

(a) forcing a pressurized mixture of combustion gas and air through a multitude of first small distinct channels in a first block of material, each channel being perpendicular to a radiation surface and having a cross-sectional area such that the velocity of the mixture through said channel is greater than the velocity of the flame propagation in the mixture and being extended until it meets with a second small channel in a second block of material containing a multitude of said second channels which are in direct alignment with said first small channels, the cross-sectional area of the second channels being a varying one commencing with that of the first section and then expanding in bowlshaped fashion until the second channel makes contact with the top surface of the second block of material, which combined with said first block forms a burner block assembly;

(b) allowing said mixture to expand and form a turbulent mixture in said second channel of said second block;

(c) allowing said turbulent mixture to ignite and burn in said second block of material, thereby heating the top surface of said second block to a very high incandescence temperature and causing it to produce very efficient infrared radiation.

The above-mentioned first block of material, which is also referred to hereafter as the "distribution block", should have low coefficients of both thermal expansion and thermal conductivity, as well as high temperature resistance. Various ceramic materials can meet such needs, for example, bonded aluminum oxide fibers, lithium aluminum silicate, and materials sold under various trade names. The above-mentioned second block of material, which is referred to hereafter as the "radiation block", should, in addition to having high temperature resistance and a low coefficient of thermal expansion, have a high emissivity and/or the ability to receive a surface oxide deposit or coating which exhibits a high infrared emissivity in the wavelength region of 1.5 to 2.0 microns. Silicon carbide is one such material, and there are various metal oxides coatings, which will meet such needs. Preferably, the radiation block should have a high coefficient of thermal conductivity.

When the first and second blocks are "combined" to form a burner assembly, this may be accomplished in a number of ways, e.g. they may be laminated or held together by a chemical bonding/sealing means, or held together mechanically. The overall thickness of the assembly is typically less than 2.5 cm and the second block is thinner than the first block.

As an optional arrangement in any of the above embodiments, a surface screen may be used to increase the overall radiation of the assembly. In prior art burners, a high temperature metal screen is used which has a relatively high heat capacity and takes time to "cool down"; it also has a relatively low radiant surface area. It is therefore a further object of this invention to provide a reverberation/enhancement screen/layer of material, which will have a very low heat capacity and a high radiant surface area of high emissivity.

Thus, the present invention is also directed to a method for providing a reverberation layer for gasfired infrared burners, which comprises:

(a) providing a burner block which will perform the functions of transporting, distributing and combusting a mixture of combustion gases and radiate the resulting infrared energy; and providing a reverberation layer of material, consisting of a multitude of small spaces connected together, which has a low heat capacity and a relatively high radiant surfaces area of high emissivity.

In a further embodiment, the above burner block may consist of separate layers of material having different properties as already described above.

In a still further embodiment and in line with the burner assembly concept of this invention, this fifth function of reverberation, when provided in the form of a porous reticulated structure, may be combined with or bonded to the main burner assembly as a special layer of material to form an overall composite assembly of three layers of material. Thus, the first layer would continue to perform the functions of transporting and distributing the gas mixture (and flame arresting), and the second layer would generate by combustion the primary infra-red radiation and finally the third layer would enhance this.

Finally, returning again to the basic two block/layered assembly, the preferred embodiment is to perform the functions of transporting and distributing the gas mixture (and flame arresting) in the first block of material and to perform the functions of combustion, radiation and reverberation/enhancement in the second block, in order to maximize the use of the three modes of heat transfer, conduction, convection and radiation, within the burning mixture in that one block, thereby maximizing the final mode, that of radiant energy from that second block.

BRIEF DESCRIPTION OF THE DRAWINGS

This invention will now be described in further detail having reference to the accompanying drawings, wherein.

DETAILED DESCRIPTION OF THE PREFERRED EMBODIMENT

Figure 1:
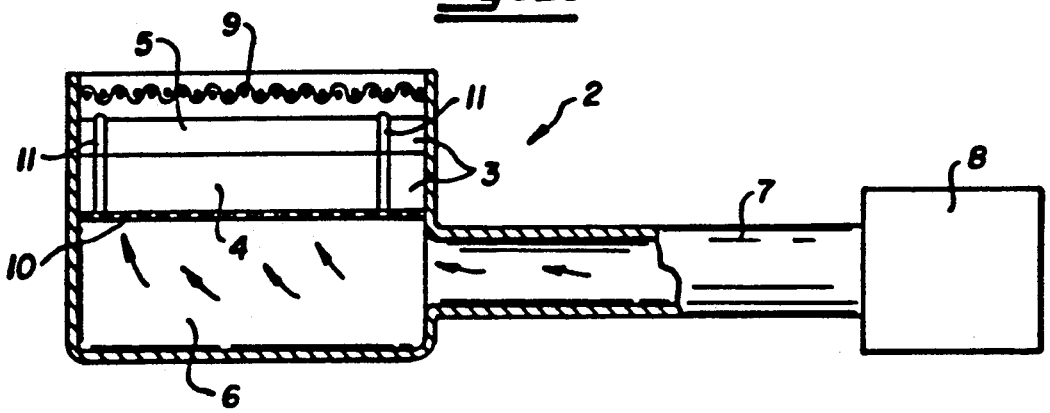
FIG. 1 illustrates, in cross-section, a type of infrared burner unit in which the present invention, involving a composite burner plate/block assembly, may be used.

Referring to FIG. 1, numeral 2 illustrates a type of infrared burner unit in which the present invention, involving a composite burner plate/block assembly 3, may be used. Burner block assembly 3 has a first block of material or distribution block 4, to transport and distribute a mixture of combustion gas and air to a second block of material or radiation block 5, which is different from the material in distribution block 4. The block acts as a gross gas distributor to aid in spreading the gas flow evenly through the assembly. Radiation block 5 will complete the transportation and distribution of the mixture and provide a combustion zone, wherein the gas can burn and heat the top surface of the second block of material 5 to incandescence (generally in the range of 1100°-1400° C.) such that it will produce very efficient infrared radiation. The mixture is initially ignited adjacent the upper surface of block 5, e.g. by a conventional piezoelectric igniter or pilot flame (not shown). Means are provided to combine the first and second blocks of material, i.e. distribution block 4 and radiation block 5, to form the burner block assembly 3. Such means to hold blocks 4 and 5 together may include chemical bonding, such as molecular bonding, sealing, gluing, etc. and/or mechanical bonding, such as molecular attraction, clamping, etc. Since chemical bonding will depend on the type of block material used, for purposes of illustration only, a more general type of mechanical bonding will be used, i.e. clip-like clamps 11.

Figure 2:
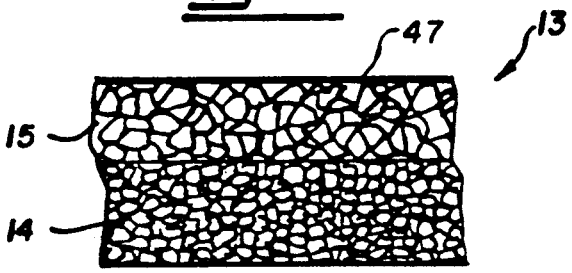
FIG. 2 illustrates a portion of a cross-sectional view of an embodiment of such a composite block, involving separate blocks for distribution and for radiation.
Figure 3:
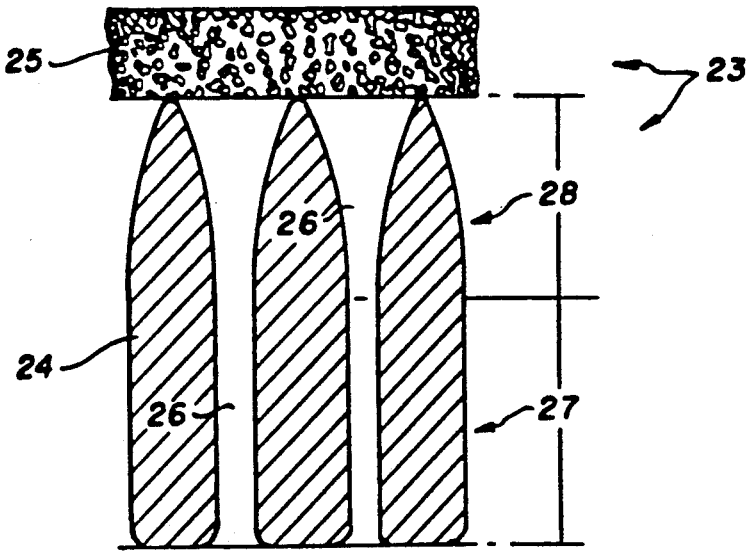
FIG. 3 illustrates a similar cross-section of another embodiment involving separate distribution and radiation blocks, combined in one assembly.
Figure 4:
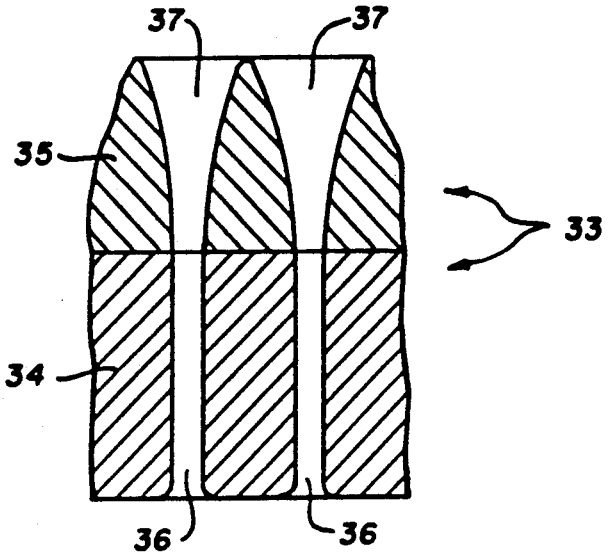
FIG. 4 illustrates still another embodiment of such a composite assembly.

Various embodiments of block assembly 2 are illustrated in FIGS. 2, 3 and 4. Block assembly 3 forms a gas-air outlet surface or side of an enclosed plenum chamber 8. The mixture of gas and air enters chamber 6 through tube 7 from a source 8. While source 8 preferably supplies pressurized gas and air sufficient to provide the required mass flow rate, in certain cases, a conventional venturi aspirator may be used. The air and combustion gas mixture supplied from source 8 will support complete combustion without the need of any auxiliary air.

A special metal screen or mesh 9 is provided at a short distance from the top of radiation block 5. Screen 9 is heated to incandescence by the combustion of the gas-air mixture, thereby producing radiant heat in addition to that being produced by radiation block 5.

To further reduce flashback, the inlet side to distribution block 4 is provided with a thin metal screen or membrane 10, containing a large number of small holes or orifices, the size of which is small enough to serve as a flame arrester during low gas-air flow rates. However the screens 9 and 10 may, if desired, be omitted.

The length and width of each block assembly will depend on the use to which the assembly is put; consequently, details involving cross-sectional views only are shown. As mentioned above, the overall thickness of the assembly is generally not greater than 2.5 cm. and the radiation block is generally thinner than the distribution block.

Referring to FIG. 2, which illustrates in greater detail a portion of a cross-sectional view of an embodiment of the block assembly 3 of FIG. 1, reference numeral reference 13 indicates such a portion, consisting of a portion of a first block of material or distribution block 14, comprising a multitude of small first spaces (not shown) connected together, and a second block of material or radiation block 15, comprising a multitude a second small spaces connected together, which spaces are larger than those of the first spaces in distribution block 14. The size of the first spaces are such that, on forcing a pressurized mixture of combustion gas and air through the small first spaces in the first or distribution block of material 14, the velocity of flow will be greater than the velocity of the flame propagation in the mixture. The sizes of the second spaces in the second or radiation block of material 15 are such as to allow the mixture to expand and form a turbulent mixture and to ignite and burn, thereby heating the top surface of the radiation block 15 to a very high incandescence temperature and causing it to produce very efficient infrared radiation. The material in each block may have a reticulated structure, involving a precise and uniformly distributed cellular pore structure, which may be expressed in terms of porosity, radiation block 15 having a greater porosity than the distribution block 14. As also mentioned, the thermal conductivity and expansion of the distribution block 14 should be low, e.g. the thermal conductivity should be low enough so as to present a cool surface to the gas plenum, i.e. approx. 150°C., to prevent flashback. Various porous ceramic materials provide such properties. While the thermal expansion of radiation block 15 should also be low, its thermal conductivity, temperature resistance, and emissivity should be as high as possible, silicon carbide being one such material, or alternatively, it must be able to accept a surface coating 47 of a high emissivity material, e.g. metal oxide coatings, such as those of cobalt, nickel, chromium, and thorium, as well as metal silicates and siliceous carbide. Some of these materials may also be impregnated into the top layer. Optional screens 9 and 10 mentioned in connection with FIG. 1 may be provided here to advantage: this could extend the choice of porous materials. Depending on the type of reticulated material chosen, the radiation block could be very much thinner than the distribution block, e.g. 2-6 mm compared to 10-20 mm for the distribution block, which should be thick enough to provide back pressure for the gas-air mixture to allow uniform combustion across a large number of burner surfaces connected to the same manifold. The pore size of block 14 should also be small enough so as to prevent flashback.

Referring to FIG. 3, which illustrates in greater detail a further embodiment of the block assembly 3 of FIG. 1, reference numeral 23 indicates a portion of a cross-sectional view of a block assembly, consisting of a first block of material or distribution block 24, comprising a multitude of small distinct channels 26, each channel being perpendicular to the radiation surface and consisting of a first section 27, and a second section 28, the first section having a cross-sectional area smaller than that of a second section 28, such that when a pressurized mixture of combustion gas and air is forced through section 27, the velocity of the mixture through the first section 27 is greater than the velocity of the flame propagation in the mixture. The cross-sectional area of the second section 28 is a varying one commencing with that of the first section and then expanding in bowl-shaped fashion until section 28 makes contact with a second block of material or radiation block 25, consisting of a multitude of spaces connected together, into which the mixture is forced to flow. The sizes of the spaces in the second or radiation block 25 are such as to allow the mixture to expand and form a turbulent mixture and to ignite and burn, thereby heating the top surface of the radiation block 25 to a very high incandescence temperature and causing it to produce very efficient infrared radiation.

The materials and design of the channels for distribution block 24 are well known in the prior art. The thermal conductivity and expansion of distribution block 24 should be low, as provided by various ceramic materials, such as aluminum oxide fibers; lithium aluminum silicate; and those sold under various trade names, e.g. "Cordiorite" TM, "Mullite" TM, etc. The design of the channels is disclosed in e.g. U.S. Pat. Nos. 3,885,907 and 3,635,644. Details for radiation block 25 are the same as those for radiation block 15 discussed in connection with FIG. 2.

It will be noted that since distribution and combustion can take place in section 28 of distribution block 24, an even thinner radiation block 25 can be used in this embodiment than in that shown in FIG. 2. It may be noted that radiation block 25 can serve to retard "lift-off" of the flame and thereby allow for a wider range of gas-air flow rates/energy inputs. Whether or not combustion takes place in the expanded section of the distribution block 24 will depend on the flow rate, the thickness and porosity of radiation block 25, as well as the design of that particular section.

Referring to FIG. 4, which illustrates in greater detail a still further embodiment of the block assembly 3 of FIG. 1, reference numeral 33 indicates a portion of a cross-sectional view of the block assembly, consisting a multitude of first small distinct channels 36 in the distribution block 34. Each channel 36 is perpendicular to the radiation surface and has a cross-sectional area such that when a pressurized mixture of combustion gas and air is forced through distribution block 34, the velocity of the mixture through channels 36 is greater than the velocity of the flame propagation in the mixture, each channel 36 being extended until it meets with at least one second, small channel 37 in a second block of material or radiation block 35, containing a multitude of second channels 37, which are in direct alignment with the first small channels 36. The cross-sectional area of second channels 37 is a varying one commencing with that of the first channels, and then expanding in bowl-shaped fashion until the second channel 37 makes contact with the top surface of the radiation block 36. The size and shape of channels 37 in the radiation block 35 are such as to allow the mixture to expand and form a turbulent mixture and to ignite and burn, thereby heating the top surface of the radiation block 35 to a very high incandescence temperature, causing it to produce very efficient infrared radiation. The materials and design of the channels for distribution block 34 would be the same as for the first meeting of the channels described in distribution block 24 in connection with FIG. 3. The design of the channels for the radiation block 35 is the same as that of those shown in FIG. 3. The design of the channels for the radiation block 35 is the same as for the second section of the channels in the distribution block 24 and described in connection with FIG. 3, i.e. as disclosed in the aforesaid United States patents. The materials for radiation block 35, however, should be carefully chosen, and as mentioned above, in addition to having high temperature resistance and a low coefficient of thermal expansion, they should have a high emissivity and/or the ability to receive a surface oxide deposit or coating which exhibits a high infrared emissivity in the wavelength region of 1.5 to 2.0 microns, e.g. silicon carbide or various metal oxides coatings, as mentioned above in connection with FIG. 2. Preferably, the radiation block should have a high coefficient of thermal conductivity. The thicknesses of the distribution and radiation blocks will depend on the type of material and prior art design for the channels that might be selected.

While FIGS. 3 and 4 show a gradual expansion of the sections or channels, i.e. sections 28 in FIG. 3 and channel 37 in FIG. 4, the expansion could also be fairly abrupt at first so as to form a bowl with nearly perpendicular sides, rather than a gradual cone-shaped bowl.

The use of the above optional screen should be given consideration, as it will increase the radiation efficiency of the overall assembly. This arises from the following: while the total emissivity is a function of the temperature and radiating surface area, the radiation surface will reach a point of diminishing returns with higher energy inputs; however, a proper screen mounted above the radiating surface will increase the radiation output, because the screen captures the flue gases and converts this exhaust energy to radiant energy, and also by trapping this cushion of gases, it provides an extension of the effective radiant surface by reverberation, and the same time prevents ambient air from reaching the emitting surface. Such a screen may be made from a high temperature metal or from a reticulated open ceramic structure, as already mentioned above.

While the above discloses a general embodiment, involving separate materials having different properties for the various functions, the preferred embodiments involve the use of reticulated materials having specific porosities. This preference arises from the following:

The three critical parameters for an infrared emitter are: surface area, temperature and emissivity. The emissivity varies with temperature and the nature of the material, so by choosing a material which inherently already has a high emissivity, the fact that it has a recticular/porous structure will further increase its emissivity. Various materials are disclosed above, with porous silicon carbide being an excellent example.

Figure 6:
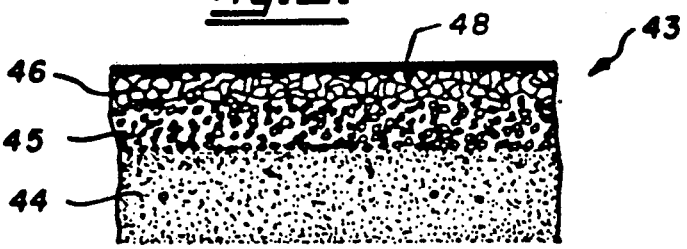
FIG. 6 illustrates a cross-section of another embodiment involving separate distribution (transportation), primary radiation (combustion) and reverberation (enhancement) layers of material, combined all in one assembly.

For a given radiating material, the radiant flux/energy will increase in proportion to the total surface area of the radiating body which is seen by the absorbing body. As can be seen by comparing the radiating surface of FIG. 4 with those of FIGS. 2, 3 and 6, the surfaces of the porous body 15 in FIG. 2, body 25 in FIG. 3, and body 45 in FIG. 6 are each substantially greater than that of the upper surface 35 in FIG. 4 (surface 35 being a typical surface for a conventional emitter). Thus, while the radiant surface of a conventional emitter is a relatively small fraction of the total surface, the radiant surface of the emitter of the present invention is nearly 100% of the total surface.

Figure 5:
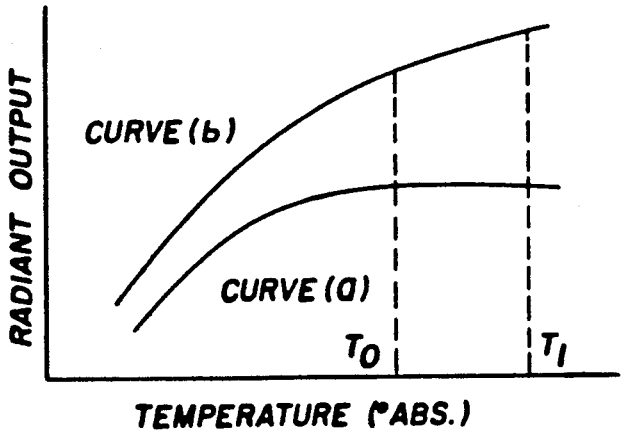
FIG. 5 is a graph showing the relationship between the radiant output and the temperature of the emitter.

Nevertheless, of the three parameters, temperature can be the most important as the radiant output varies as the fourth power of the absolute temperature of the emitter. However, in practice as one tries to increase the temperature of a given emitter, the output levels off because of the nature of the surface and the method of producing the temperature. This is illustrated in FIG. 5, where curve (a) is that for a typical conventional emitter and where by increasing the temperature from T0 to T1, the output remains essentially the same. Factors causing this saturation were touched on in the above and include: insufficient contact area between the flame and the emitting material and conventional emitters depend on flame impingement on the emitter surface for heat transfer; further energy input by increasing gas flow merely results in "flame lift-off".

Curve (b) on the other hand, is typical for embodiments of FIGS. 2, 3 and 6, which involve a porous/-reticulated structure.

As can be seen, because the emitter of curve (b) has more surface area and a higher emissivity, its radiant output at temperature T0 will be greater than that of the conventional emitters of curve (a) at the same temperature T0. However in addition because of the nature of the emitter, the manner in which the combustion is taking place (and the conversion of energy from convection to radiant) within the emitter, and its greater resistance to "lift-off", the curve does not level off as quickly, but continues to rise, making possible a further increase in the output by an increase in temperature of the emitter (through higher gas flows). This invention, therefore, allows one to take advantage of the benefits of the higher temperatures. Thus, when operating at the recommended temperatures for the emitter of the present invention, its emissivity is in the range of 0.6–0.95.

The above aspects have led the inventor to provide a further embodiment in which reverberation/enhancement is preferably carried out through the use of a highly porous/reticulated layer of material, rather than a conventional metal screen. This was mentioned above. In such a case, while the highly porous reverberation material can be located at a very short distance above the primary porous emitter, it is preferable to combine or bond it to the top surface of the primary emitter. This is illustrated in FIG. 6, which is a cross-sectional view of the burner assembly of FIG. 1 (without the use of clips), indicated by reference numeral 43, i.e. of the various individual assembly units that might make up the overall burner unit. This assembly consists of a first block of material or distribution block 44, comprising a multitude of small first spaces (not shown) connected together, a second block of material or radiation block 45, comprising a multitude of second small spaces connected together, which spaces are larger than those of the first spaces in the distribution block 44, and a third block/layer or reverberation block 46, comprising a multitude of third small spaces connected together, which spaces are still larger than those of the second block. Details of the first and second blocks are given in reference to that illustrated in FIG. 2 above.

While the overall assembly can be physically held together as illustrated in FIG. 1, it preferable that the various layers/blocks be bonded together for reasons that will be given below. A typical example for such an assembly is: the first or distribution block may have a porosity in the range of 60–85 ppi and be made from LAS (lithium alumina silicate) or "petalite"; the second or primary radiation (combustion) block may have a porosity in the range of 25–50 ppi and be made from LAS or silicon carbide (coated or impregnated with a higher emissivity material); the third or reverberation (enhancement) layer may have a porosity in the range of 5–10 ppi and be made from silicon carbide. Thickness of the layers will depend on various factors, but typical ranges are: first block, 10–20 mm; second block 2–6 mm; and third block 2–6 mm.

The advantages given above for a porous emitter (when used without reverberation), will also apply to the above porous reverberator when it is used with an emitter, and thereby make it a more efficient enhancer than conventional screens. However, another important feature for such a reverberation layer of very high porosity is that it can be made from a high temperature ceramic material such as silicon carbide. This material does not degrade easily at the very high temperatures used for emitters and this raises the following further advantages: it has a long operating life and advantage can be taken of the use of still higher temperatures, which in turn increase the radiant output substantially (see curve (b), FIG. 5). In contrast, conventional high temperature screens operating at a the temperature of 1150° C. have an operating life of only 2000–3000 hours. Since the above porous layer would properly operate in the range 1100°–1400° C., not only would the radiant output be much higher at this temperature level, but the life of the porous layer would be very much greater than that of a conventional screen operating at the lower safer level. Should attempts be made to operate this conventional screen at the higher temperature levels that this invention can operate at, then its life would drop even substantially lower. Recent improvements in the manufacture of ceramic materials have made the attainment of the above-mentioned embodiments, especially that involving combining the functions of combustion radiation and reverberation all within one block/layer, somewhat easier. Thus, the base material may be silicon carbide (SiC) and/or silicon nitride ($Si_3N_4$), which may be coated with a very thin layer of silicon carbide/silicon nitride, which makes the structure very strong and shock resistant. To lower the thermal conductivity of the base material when used in the lower first block of material in certain applications, it may be diluted with lower conductivity material such as <AS.

Thus, looking at this two block/layered assembly in more detail, as it is illustrated in FIG. 2, the transportation and distribution of the gas mixture takes place in layer 14, whose pore size, expressed as pores per inch (ppi) and apparent porosity (ratio of the volume of open pore space to the bulk/overall volume of the material), is such that the velocity of the gas flow in this layer is above the velocity of flame propagation and little if any combustion takes place in that layer, the pore size and apparent porosity of the second layer 15, being such that most of the combustion takes place in this layer in order to make maximum use of the three modes of heat transfer (conduction, convection and radiation) during the combustion process, to thereby concentrate, reverberate and enhance the energy level and maximize the gas temperature and its rapid development and hereby attain a very high level of final radiation. However, the pore size and apparent porosity in layer 15 must not be too great such that the structure would collapse under the higher temperatures that are generated by this new type of layer. Preferred ranges for these layers are as follows:

(1) in the first or main block/layer 14; a ppi in the range of 40–70 and an apparent porosity in the range of 75–95%. The thickness will depend on the pore size and is discussed above in connection with other embodiment. At this pore size and porosity or low mass (and even though the material may have high conductivity) little preheating of the gas mixture occurs in this layer.

(2) in the special reverberation layer 15, a ppi of less than 15 and an apparent porosity the same as the main layer or within the same range. The thickness should be less than about two pores, so that as the combustion heats the top surface of the main layer 14 it can make use of its high emissivity (in some applications the hot top layer of the first block can radiate over 70% of the total radiation).

As implied in the above, the preferred materials for all embodiments are silicon carbide/silicon nitride, very thinly coated 48 by the same material(s), as they are very resistant to temperature and corrosion, have a high emissivity (greater than 0.9) and a high thermal conductivity (both for use during the combustion) and the pores appear to offer a special resistance to gas flow so that larger pores and/or thinner layers can be used.

One such burner assembly embodying the present invention has the following features: two porous cellular layers bonded together and made from SiC coated with SiC (emissivity about 0.95), both layers having about the same apparent density in the range of 80–85%, the main layer pore size being about 65 ppi and was approx. ⅜ inch thick; and the thin other layer having a pore size of about 10 ppi and being approx. ⅛ inch thick (approx. 1.2 pores).

A similar thin outer layer may also be applied to assembly 23 of FIG. 3, where it is represented as layer 25, However, the dimensions of section 28 are then such that a minimum of combustion takes place in that section.

It should be noted that, while the apparent porosity in each block/layer is about the same, the actual size of each pore in each layer is substantial different. The pore size in ppi, taken together with the apparent density, will determine the actual pore size or diameter of the open area. Similarly, while the specific thermal conductivity of the material in each layer can be about the same, the mass conductivity may not be very high due to the high pore size and apparent porosity, i.e. its low mass.

Conventional burners use metal parts in various areas, as well as for the reverberation screen, and in addition use dense ceramic for the burner itself; the relatively high heat capacity of these materials has the result that when the burner is turned off, the "cool-down period" is relatively long, e.g. 180–360 seconds. While the use of metal parts to hold the assembly of the present invention together is not forbidden, in its preferred form, the various layer/blocks are bonded together chemically, thereby eliminating the high heat capacity of these metal parts. As mentioned above, the very low heat capacity of the various porous layers makes the overall heat capacity of the assembly extremely low, with the result that the "cool-down period" can be less than 5–10 secs.

Besides resulting in a very short "cool-down", the highly porous materials can also have a very low heat conductivity, so by choosing such a material for the distribution block, all surfaces, other than those involved in combustion and reverberation, remain relatively cool to the touch, compared to prior art assembly surfaces, which are so hot that they can ignite flammable material.

These features of very short "cool-downs" and cool outer surfaces are very important in applications involving such flammable materials as paper and textiles. These are important safety features both from a fire hazard point of view as well as for those persons who have to operate the burners and the associated paper/-textile manufacturing equipment.

The high shock resistance of the preferred materials, i.e. $SiC/Si_3N_4$ thinly coated with the same material, also offer advantages in those applications where cold water may be accidentally splashed on these burner assemblies. Prior art ceramics made from weaker materials would be hazardous in such cases.

Although illustrated embodiments of the present invention have been described herein with reference to the accompanying drawings, it is to be understood that the invention is not limited to those precise embodiments, and that various changes and modifications may be made by those skilled in the art without departing from the spirit and scope of this invention.

The embodiments of the invention in which an exclusive property or privilege is claimed are defined as follows:

1. A method for producing infrared radiation, which comprises the steps of:

(a) forcing a pressurized mixture of combustion gas and air through a multitude distinct channels in a first block of material, each channel is perpendicular to the radiation surface and consists of two sections, the first section having a cross-sectional area smaller than that of the second section such that the velocity of the mixture through said first section is greater than the velocity of the flame propagation in the mixture, the cross-sectional area of the second section being a varying one commencing with that of the first then expanding in bowl-shaped fashion until the section at least substantially makes contact with a second block of material, consisting of a multitude of spaces connected together, into which the mixture is forced to flow, and which combined with said first block forms a burner block assembly;

(b) allowing said mixture to expand and form a turbulent mixture in said second section of said first block and in said spaces of said second block;

(c) allowing said turbulent mixture to ignite and burn in said second block of material thereby heating the top surface of said second block to a very high incandescence temperature causing it to produce very efficient infrared radiation.

2. The method of claim 1, wherein the material in said second block of porous reticulated structure.

3. The method of claim 1, wherein the second block comprises at least one material selected from the group consisting of: silicon carbide and silicon nitride.

4. The method of claim 3, wherein the top surface of said material is coated with at least one material selected from the group consisting of: cobalt oxide, nickel oxide, chromium oxide, thorium oxide, silicon carbide, metal silicate.

5. The method of claim 1, wherein said second block has a porosity in the range of 25–50 ppi, and has a thickness in the range of 2–6 mm.

6. The method of claim 3, wherein the second block is coated with a very thin layer of at least one material selected from the group consisting of: silicon carbide and silicon nitride.

7. A method for producing infrared radiation, which comprises steps of:

(a) forcing a pressurized mixture of combustion gas and air through a multitude of first small distinct channels in a first block of material, each channel is perpendicular to the radiation surface and has a cross-sectional area such that the velocity of the mixture through said channel is greater than the velocity of the flame propagation in the mixture and being extended until it meets with a second small channel in a second block of material containing a multitude of said second channels which are in direct alignment with said first small channels, the cross-sectional area of the second channels being a varying one commencing with that of the first then expanding in bowl-shaped fashion until the second channel makes contact with the top surface of the second block of material, which combined with said first block forms a burner block assembly;

(b) allowing said mixture to expand and form a turbulent mixture in the bowl-shaped section of said second block;

(c) allowing said turbulent mixture to ignite and burn in said second block of material thereby heating the top surface of said second block to a very high incandescence temperature causing it to produce very efficient infrared radiation.

8. The method of claim 7, wherein the second block comprises at least one material selected from the group consisting of: silicon carbide and silicon nitride.

9. The method of claim 8, wherein the top surface of said material is coated with at least one material selected from the group consisting of: cobalt oxide, nickel oxide, chromium oxide, thorium oxide, silicon carbide, metal silicate.

10. The method of claim 8, wherein the second block is coated with a very thin layer of at least one material selected from the group consisting of: silicon carbide and silicon nitride.

11. A burner assembly for gas-fired infrared burners, which comprises:

(a) means comprising a first block of material having a multitude of small first spaces for transporting and distributing a mixture of combustion gas and air;

(b) means comprising a second block of material having a multitude of second spaces which are larger than said first spaces for completing said transportation and distribution of said mixture and providing a combustion zone, wherein said mixture can burn and heat the top surface of said second block of material to incandescence such that it will produce very efficient infrared radiation; and (c) said first and second blocks of material being combined to form a burner assembly, wherein to effectively serve the functions of transportation and distribution of said mixture on the one hand, and the functions of combustion and resulting radiation on the other hand, in said first and said second blocks respectively, the porosities and thickness of the said material in the first block and in the second block are different, namely, the material in the first block comprises said first spaces expressed as a number of pores per linear inch in the range of 40-70, a percentage apparent porosity in the range of 75-95%, and a thickness commensurate with said number of pores per linear inch and said percentage apparent porosity so that the velocity of said mixture through said first block is greater than the velocity of flame propagation of the mixture through the first block when the mixture is ignited; and the said material in the second block comprises said second spaces expressed as pores per linear inch of less than 15, a percentage apparent porosity in the range of 75-95%, and a thickness less than about 2 pores, so that most of the combustion of said mixture takes place in said second block to thereby concentrate, reverberate and enhance the energy level, maximize the gas temperature and attain a very high level of radiation.

12. The assembly of claim 11, wherein at least said top surface is coated with at least one material selected from the group consisting of cobalt oxide, nickel oxide, chromium oxide, thorium oxide, silicon carbide, a metal silicate.

13. The assembly of claim 11, wherein the thermal conductivity of said first block is less than that of said second block.

14. The assembly of claim 11 wherein the emissivity of at least the top surface of the second block is greater than that of the first block.

15. A burner assembly for gas-fired infrared burners, which comprises:

(a) means comprising a first block of material having a multitude of small first spaces for transporting and distributing a mixture of combustion gas and air;

(b) means comprising a second block of material having a multitude of second spaces which are larger than said first spaces for completing said transportation and distribution of said mixture and providing a combustion zone, wherein said mixture can burn and heat the top surface of said second block of material to incandescence such that it will produce very efficient infrared radiation; and (c) said first and second blocks of material being combined to form a burner assembly, wherein at least said top surface of said second block is coated with at least one material selected from the group consisting of cobalt oxide, nickel oxide, chromium oxide, thorium oxide, silicon carbide and a metal silicate.

16. A burner assembly for gas-fired infrared burners, which comprises:

(a) means comprising a first block of material having a multitude of small first spaces for transporting and distributing a mixture of combustion gas and air;

(b) means comprising a second block of material having a multitude of second spaces which are larger than said first spaces for completing said transportation and distribution of said mixture and providing a combustion zone, wherein said mixture can burn and heat the top surface of said second block of material to incandescence such that it will produce very efficient infrared radiation; and (c) said first and second blocks of material being combined to form a burner assembly, wherein the second block is coated with a very thin layer of at least one material selected from the group consisting of silicon carbide and silicon nitride.

17. A burner assembly for gas-fired infrared burners, which comprises:

(a) means comprising a first block of material having a multitude of small first spaces for transporting and distributing a mixture of combustion gas and air;

(b) means comprising a second block of material having a multitude of second spaces which are larger than said first spaces for completing said transportation and distribution of said mixture and providing a combustion zone, wherein said mixture can burn and heat the top surface of said second block of material to incandescence such that it will produce very efficient infrared radiation; and (c) said first and second blocks of material being combined to form a burner assembly, and a reverberation layer of material on said second block material, consisting of a multitude of small spaces connected together, which has a low heat capacity and a radiant surface area of relatively high emissivity.

18. The assembly of claim 17, wherein said material consisting of a multitude of small spaces is a material of a porous reticulated structure.

19. The assembly of claim 17 wherein the first block comprises material having between 25 and 50 ppi and has a thickness of between 10 and 15 mm, the second block comprises material having between 80 and 90 ppi and a thickness of between 5 and 10 mm, and the reverberation layer comprises material having less than 15 ppi and a thickness of between 2 and 6 mm.

20. The assembly of claim 19 wherein at least all of the surfaces of the reverberation layer, and the top surface of the second block are coated with a very thin layer of at least one material selected from the group consisting of silicon carbide and silicon nitride.

21. The assembly of claim 17, wherein the first block has a porosity in the range of 60–85 ppi and a thickness in the range of 10–20 mm, the second block has a porosity in the range of 25–50 ppi and a thickness in the range of 2–6 mm, and said reverberation layer has a porosity in the range of 5–10 ppi, and has a thickness in the range of 2–6 mm.

22. The assembly of claim 17, wherein the reverberation layer comprises at least one material selected from the group consisting of silicon carbide and silicon nitride.

23. The assembly of claim 17, wherein said material in said first block comprises spaces expressed as a number of pores per linear inch in the range of 40–70, a percentage apparent porosity in the range of 75–95%, and has a thickness commensurate with said number of pores per linear inch value and said percentage apparent porosity so that the velocity of said mixture through said first block is greater than the velocity of flame propagation of the mixture through the first block when the mixture is ignited; said material in said second block comprises spaces expressed as a number of pores per linear inch of less than 15, has a percentage apparent porosity in the range of 75–95% and a thickness of less than about 2 pores, so that most of the combustion of said mixture takes place in said second block; and said reverberation layer material comprises spaces expressed as a number of pores per linear inch of about 10, has a percentage apparent porosity in the range of 80–95% and a thickness of about 0.32 cm., so as to concentrate, reverberate and enhance the energy level, maximize the gas temperature and attain a very high level of radiation.

24. The assembly of claim 19, wherein at least the top surface of the assembly is coated with at least one material selected from the group consisting of cobalt oxide, nickel oxide, chromium oxide, thorium oxide, silicon carbide, a metal silicate.

25. The assembly of claim 19, wherein at least the reverberation layer is coated with a very thin layer of at least one material selected from the group consisting of silicon carbide and silicon nitride.

26. The assembly of claim 17, wherein the first block comprises material having between 40 and 85 ppi and has a thickness of between 10 and 20 mm, the second block comprises material having between 25 and 50 ppi and a thickness of between 2 and 6 mm, and the reverberation layer comprises material having less than 15 ppi and a thickness of between 2 and 6 mm.

27. The assembly of claim 26 wherein at least all of the surfaces of the reverberation layer, and the top surface of the second block are coated with a very thin layer of at least one material selected from the group consisting of silicon carbide and silicon nitride.

28. A method for producing infrared radiation, which comprises the steps of:

(a) forcing a pressurized mixture of combustion gas and air through a multitude of small first spaces connected together in a first block of material at a velocity which is greater than the velocity of the flame propagation in the mixture, into a second block of material, which, while containing a multitude of spaces connected together which are larger than those of the first spaces, is combined with said first block to form a composite burner block assembly;

(b) allowing said mixture to expand and form a turbulent mixture in said second block;

(c) allowing said turbulent mixture to ignite and burn, thereby heating the top surface of said second block to a very high incandescence temperature and causing it to produce very efficient infrared radiation, wherein at least the top surface of said material is coated with at least one material selected from the group consisting of cobalt oxide, nickel oxide, chromium oxide, thorium oxide, silicon carbide and a metal silicate.

29. The method of claim 28, wherein the second block comprises at least one material selected from the group consisting of silicon carbide and silicon nitride.

30. A method for producing infrared radiation, which comprises the steps of:

(a) forcing a pressurized mixture of combustion gas and air through a multitude of small first spaces connected together in a first block of material at a velocity which is greater than the velocity of the flame propagation in the mixture, into a second block of material, which, while containing a multitude of spaces connected together which are larger than those of the first spaces, is combined with said first block to from a composite burner block assembly;

(b) allowing said mixture to expand and form a turbulent mixture in said second block;

(c) allowing said turbulent mixture to ignite and burn, thereby heating the top surface of said second block to a very high incandescence temperature and causing it to produce very efficient infrared radiation, wherein at least the outer surface of the second block is coated with a very thin layer of at least one material selected from the group consisting of silicon carbide and silicon nitride.

31. The method as in claim 30, wherein the second block comprises at least one material selected from the group consisting of silicon carbide and silicon nitride.

32. A method for producing infrared radiation, which comprises the steps of:

(a) forcing a pressurized mixture of combustion gas and air through a multitude of small first spaces connected together in a first block of material at a velocity which is greater than the velocity of the flame propagation in the mixture, into a second block material, which, while containing a multitude of spaces connected together which are larger than those of the first spaces, is combined with said first block to form a composite burner block assembly;

(b) allowing said mixture to expand and form a turbulent mixture in said second block;

(c) allowing said turbulent mixture to ignite and burn, thereby heating the top surface of said second block to a very high incandescence temperature and causing it to produce very efficient infrared radiation, wherein said first block has a porosity in the range of 60–85 ppi, and has a thickness in the range of 10–20 mm; and said second block has a porosity less than 15 of ppi, and has a thickness in the range of 2–6 mm.

* * * * *